US008606155B2

(12) United States Patent
Kimata et al.

(10) Patent No.: US 8,606,155 B2
(45) Date of Patent: Dec. 10, 2013

(54) FIXING DEVICE WITH A SEPARATION SECTION CONFIGURED TO BLAST GAS FROM A HEAT RECEIVING DUCT, AND IMAGE FORMING APPARATUS INCORPORATING THE SAME

(75) Inventors: Akinori Kimata, Toyokawa (JP); Masashi Sugano, Hachioji (JP); Katsunori Takahashi, Hachioji (JP); Akifumi Isobe, Hidaka (JP); Kenji Tamaki, Tokorozawa (JP); Satoshi Shimao, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 321 days.

(21) Appl. No.: 13/044,363

(22) Filed: Mar. 9, 2011

(65) Prior Publication Data

US 2011/0222922 A1 Sep. 15, 2011

(30) Foreign Application Priority Data

Mar. 12, 2010 (JP) ..... 2010-055980

(51) Int. Cl.
*G03G 15/20* (2006.01)

(52) U.S. Cl.
USPC ..... 399/323

(58) Field of Classification Search
USPC ..... 399/323, 322, 92, 406
See application file for complete search history.

(56) References Cited

U.S. PATENT DOCUMENTS 3,734,604 A * 5/1973 Szostak et al.
4,051,835 A * 10/1977 Hinson-Rider
4,116,224 A * 9/1978 Lupkas
4,119,085 A * 10/1978 Knowles et al.
4,154,521 A * 5/1979 Tanaka
4,720,727 A * 1/1988 Yoshida
4,959,693 A * 9/1990 Mitsuya et al. ..... 399/322
5,459,562 A * 10/1995 Mitsuya et al.

(Continued)

FOREIGN PATENT DOCUMENTS

JP 5-3416777 12/1993
JP 08054801 A * 2/1996
JP 2005-157179 6/2005

OTHER PUBLICATIONS

State Intellectual Property Office of People's Republic of China, First Office Action issued May 6, 2013 by SIPO (8 pp).

(Continued)

*Primary Examiner* — Susan Lee
(74) *Attorney, Agent, or Firm* — Finnegan, Henderson, Farabow, Garrett & Dunner, L.L.P.

(57) ABSTRACT

Disclosed is a fixing device, which makes it possible to prevent the air blasting section from deterioration, caused by heat transferred from the duct to the air blasting section. The fixing device includes a fixing section to fix the toner image onto the paper sheet; a heat source; and a separating section to separate the paper sheet from the pair of fixing members. On the other hand, the separating section includes: a gas blasting section to blast a gas; and a duct to guide the gas towards the pair of fixing members, and that is provided with a duct wall serving as a heat receiving surface to receive radiation heat irradiated from the fixing section, and at least one of the gas blasting section and the duct is provided with such a connection structure that suppresses heat transferring action from the duct to the gas blasting section.

19 Claims, 9 Drawing Sheets

(56) References Cited

U.S. PATENT DOCUMENTS

| | | | | |
|---|---|---|---|---|
| 6,922,538 | B2 * | 7/2005 | Kimura | |
| 7,085,511 | B2 * | 8/2006 | Park | |
| 7,356,277 | B2 * | 4/2008 | Iijima et al. | 399/92 |
| 7,712,318 | B2 * | 5/2010 | Iwasaki | |
| 2003/0035666 | A1 * | 2/2003 | Ishikawa et al. | |
| 2005/0201795 | A1 * | 9/2005 | Kawachi et al. | 399/406 |
| 2006/0110172 | A1 * | 5/2006 | Iijima et al. | |
| 2007/0003314 | A1 * | 1/2007 | Shuto | 399/92 |

OTHER PUBLICATIONS

Japanese Notice of Reasons for Refusal Mailed Jul. 23, 2013 in Counterpart Japanese Patent Application No. 2010-055980 (6 pages total).

* cited by examiner

FIXING DEVICE WITH A SEPARATION SECTION CONFIGURED TO BLAST GAS FROM A HEAT RECEIVING DUCT, AND IMAGE FORMING APPARATUS INCORPORATING THE SAME

This application is based on Japanese Patent Application NO. 2010-055980 filed on Mar. 12, 2010, with Japan Patent Office, the entire content of which is hereby incorporated by reference.

BACKGROUND OF THE INVENTION

The present invention relates to a fixing device and an image forming apparatus.

Conventionally, there have been well known various kinds of image forming apparatuses that employ the electro-photographic method, such as a printer, a copier, etc. In the image forming apparatus categorized in the abovementioned kind, the operation for fixing a toner image, formed on a paper sheet, onto the paper sheet concerned has been achieved by making the paper sheet Pass through a press-contact section (hereinafter, referred to as a fixing nip area) formed between a pair of fixing members (such as, a pair of fixing rollers), which constitute the fixing device, so as to apply heat and pressure onto the paper sheet concerned. Since the heat and pressure are employed for the fixing operation, sometimes, there has occurred such a trouble that the fixing member has been rolled in the paper sheet that passed through the fixing nip area without separating from the fixing member.

For instance, Tokkai 2005-157179 (Japanese Patent Application Laid-Open Publication) sets forth such the image forming apparatus that is provided with the separation section for making the paper sheet separate from the fixing member. Concretely speaking, the separation section is constituted by the compressor (air-pump) serving as an air blasting device, and the nozzle, the air blasting edge portion of which is disposed at the paper sheet ejection side of the fixing nip area, so that the pulses of the compression air are emitted from the compressor through the nozzle so as to make the paper sheet separate from the fixing member. Further, Tokkai 2005-157179 also sets forth such the method in which the nozzle is disposed near the circumferential surface of the fixing member, so as to heat up the temperature of the compression air by utilizing the radiation heat irradiated from the fixing member or the heat generated by the heating device incorporated independently, and then, the heated compression air is emitted.

According to the method set forth in Tokkai 2005-157179, however, there has been such a fear that, since the heat to be employed for heating up the compression air is also transferred to the air blasting device concerned, the separation section would be deteriorated considerably.

SUMMARY OF THE INVENTION

To overcome the abovementioned drawbacks in conventional image forming apparatus, it is one of objects of the present invention to provide a fixing device and an image forming apparatus employing the same, which makes it possible to stably operate the separating section and to extend its lifetime, by suppressing the deterioration caused by heat Accordingly, at least one of the objects of the present invention can be attained by any one of the fixing devices and the image forming apparatus described as follows.

(1) According to a fixing device reflecting an aspect of the present invention, the fixing device that is provided with a pair of fixing members, which press-contacts with each other to form a fixing nip section, comprises: a fixing section to apply heat and pressure onto a toner image transferred onto a paper sheet by making the paper sheet pass through the fixing nip section, so as to fix the toner image onto the paper sheet; a heat source to generate the heat to be applied onto the toner image; and a separating section to blow a gas onto the paper sheet from a paper sheet ejection side of the fixing nip section so as to separate the paper sheet from the pair of fixing members; wherein the separating section comprises: a gas blasting section to blast the gas; and a duct to guide the gas blasted by the gas blasting section to the pair of fixing members, and that is provided with a duct wall serving as a heat receiving surface to receive radiation heat irradiated from the fixing section; and wherein at least one of the gas blasting section and the duct is provided with such a connection structure that suppresses heat transferring action from the duct to the gas blasting section.

(2) According to another aspect of the present invention, the fixing device recited in item 1, further comprises: a thermal insulating member that is made of a material having a thermal insulation property and that is inserted between the duct and the gas blasting section in such a state that a flow of the gas can be freely communicate between the duct and the gas blasting section.

(3) According to still another aspect of the present invention, in the fixing device recited in item 1, a gas blast opening of the gas blasting section is made of a material having a thermal insulation property, and is connected to the duct.

(4) According to still another aspect of the present invention, in the fixing device recited in item 1, a gas entrance opening of the duct is made of a material having a thermal insulation property, and is connected to the gas blasting section.

(5) According to still another aspect of the present invention, in the fixing device recited in any one of items 1-4, the gas blasting section includes a fun.

(6) According to still another aspect of the present invention, in the fixing device recited in any one of items 1-5, a black color coating is applied onto an outer surface of the duct wall serving as the heat receiving surface, and the black color coating is defined as such a coating that has any one of various kinds of colors, having a capability for heightening a heat collecting efficiency, as its general term.

(7) According to still another aspect of the present invention, in the fixing device recited in any one of items 1-6, the duct is provided with a heat condensing fin fixed or formed onto an outer surface of the duct wall serving as the heat receiving surface.

(8) According to still another aspect of the present invention, in the fixing device recited in any one of items 1-7, the duct is provided with a heat radiation fin fixed or formed onto an inner surface of the duct wall serving as the heat receiving surface.

(9) According to still another aspect of the present invention, in the fixing device recited in item 8, the height of the heat radiation fin is set at such a length that is shorter than a distance between another inner surface of an opposing wall, which opposes the inner surface of the duct wall, and the inner surface of the duct wall, so that the heat radiation fin does not reach the other inner surface of the opposing wall.

(10) According to still another aspect of the present invention, in the fixing device recited in item 8 or 9, the heat radiation fin is formed in such a shape that a resistance against the flow of the gas is made to reduce.

(11) According to still another aspect of the present invention, in the fixing device recited in any one of items 1-10, a heat conductivity of a material, of which an opposing wall located at an opposing side of the duct wall is made, is lower than that of another material, of which the duct wall serving as the heat receiving surface is made.

(12) According to an image forming apparatus reflecting yet another aspect of the present invention, the image forming apparatus, comprises: a transferring unit to transfer a toner image onto a paper sheet; and a fixing unit to fix the toner image onto the paper sheet, onto which the toner image is transferred by the transferring unit; wherein the fixing device is provided with a pair of fixing members, which press-contacts with each other to form a fixing nip section, and comprises: a fixing section to apply heat and pressure onto the toner image transferred onto the paper sheet by making the paper sheet pass through the fixing nip section, so as to fix the toner image onto the paper sheet; a heat source to generate the heat to be applied onto the toner image; and a separating section to blow a gas onto the paper sheet from a paper sheet ejection side of the fixing nip section so as to separate the paper sheet from the pair of fixing members; wherein the separating section comprises: a gas blasting section to blast the gas; and a duct to guide the gas blasted by the gas blasting section to the pair of fixing members, and that is provided with a duct wall serving as a heat receiving surface to receive radiation heat irradiated from the fixing section; and wherein at least one of the gas blasting section and the duct is provided with such a connection structure that suppresses heat transferring action from the duct to the gas blasting section.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

First Embodiment

Figure 1:
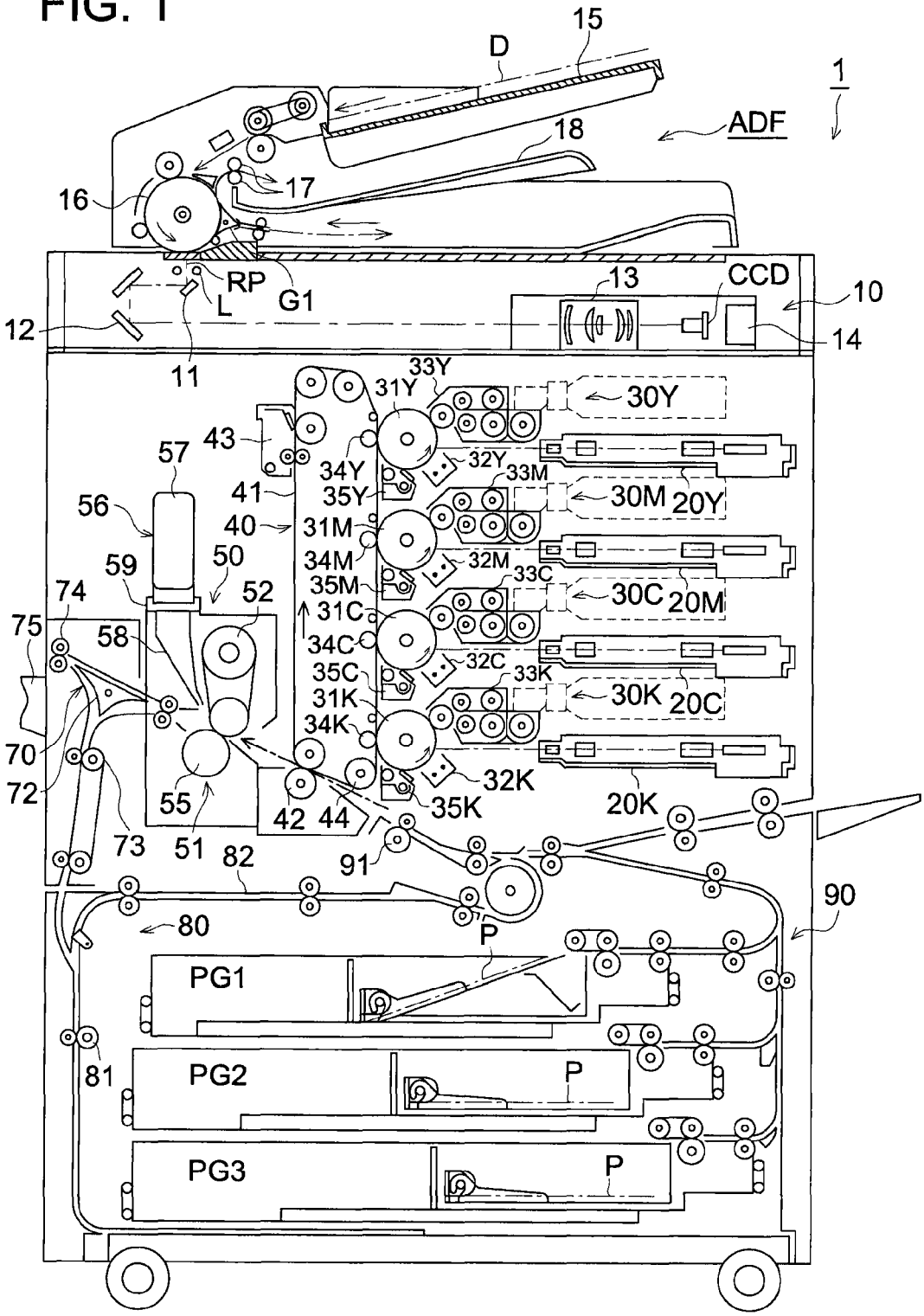
FIG. 1 shows an explanatory schematic diagram indicating a configuration of an image forming apparatus embodied in the present invention.

FIG. 1 shows an explanatory schematic diagram indicating a configuration of an image forming apparatus 1 embodied in the present invention. For instance, the image forming apparatus 1 serves as such an image forming apparatus that employs the electro-photographic image forming method, such as a copier or the like, and is configured as, so called, a tandem-type color image forming apparatus in which a plurality of photoreceptor members (photoreceptor drums) are arranged in a vertical direction in such a manner that the plurality of photoreceptor members opposes to a single intermediate transfer belt so as to form a full color image onto a sheet The image forming apparatus 1 is constituted by a document reading section 10, exposure sections 20Y, 20M, 20C and 20K, image forming sections 30Y, 30M, 30C and 30K, an intermediate transfer section 40, a fixing device 50, a paper sheet ejecting and reversing section 70, a paper sheet refeeding section 80 and a paper sheet feeding section 90, as its main constituents, which are accommodated into a single housing.

The document reading section 10 is provided with an automatic document feeder ADF mounted thereon. Documents D placed on a document placing plate 15 of the automatic document feeder ADF are sequentially picked up one by one and conveyed onto a document conveyance path, and further conveyed by a conveyance drum 16. A first conveyance guide G1 and a pair of document ejection rollers 17 guide and eject each of the documents D, conveyed by the conveyance drum 16, onto a document ejection tray 18.

The document reading section 10 reads an image of each of the documents D at a document image reading position RP, while the conveyance drum 16 is conveying the concerned document D. Concretely speaking, a lamp L irradiates light onto the image of the concerned document D at the document image reading position RP. Then, a first mirror unit 11, a second mirror unit 12 and a lens unit 13 guide reflection light reflected from the concerned image to a light receiving surface of an imager CCD (Charge Coupled Device), so as to focus the reflection light onto the light receiving surface of the imager CCD. The imager CCD converts the incident light to analogue image signals through the process of the photoelectric converting actions, and outputs the image signals in the predetermined format An image reading control section 14 applies various kinds of image processing, such as an analogue to digital conversion processing, a shading correction processing, a compression processing, etc., to the image signals outputted by the imager CCD, and stores the processed image data, acquired as a result of applying the abovementioned image processing, into a storage section provided in a control section (not shown in the drawings) as inputted image data. Successively, according to the condition established by the user, an appropriate image processing is further applied to the inputted image data stored in the storage section, so as to generate output image data. In this connection, the scope of the inputted image data is not limited to those acquired from the image signals read by the document reading section 10. For instance, image data received from a personal computer or another image forming apparatus, which are coupled to the image forming apparatus 1, may also serve as the inputted image data abovementioned.

Each of the exposure sections 20Y, 20M, 20C and 20K is constituted by a laser light source (not shown in the drawings), a polygon mirror, a plurality of lenses, etc., so as to emit a laser beam therefrom. Each of the exposure sections 20Y, 20M, 20C and 20K emits the laser beam, the intensity of which is modulated in response to the output information outputted by the control section based on the output image data, so as to perform the scanning exposure operation by scanning the laser beam onto the circumferential surface of corresponding one of photoreceptor drums 31Y, 31M, 31C and 31K, serving as constituents of the image forming sections 30Y, 30M, 30C and 30K, respectively. As a result of the scanning exposure operation employing the laser beam, latent images are formed on the circumferential surfaces of the photoreceptor drums 31Y, 31M, 31C and 31K.

The image forming section 30Y is constituted by the photoreceptor drum 31Y, and a main charging section 32Y, a developing section 33Y, a first transferring roller 34Y and a cleaning section 35Y, which are arranged along the circumferential surface of the photoreceptor drum 31Y within the peripheral space thereof. Each of the configurations of the other image forming sections 30M, 30C and 30K are substantially the same as that of the image forming section 30Y abovementioned. Namely, the other image forming sections 30M, 30C and 30K are respectively constituted by photoreceptor drums 31M, 31C, 31K, and main charging sections 32M, 32C, 32K, developing sections 33M, 33C, 33K, first transferring rollers 34M, 34C, 34K and cleaning sections 35M, 35C, 35K, which are respectively arranged along the circumferential surfaces of the photoreceptor drum 31M, 31C, 31K within the peripheral spaces thereof.

The main charging sections 32Y, 32M, 32C and 32K uniformly charge the circumferential surfaces of the photoreceptor drums 31Y, 31M, 31C and 31K, respectively, so as to make it possible to form latent images thereon Then, the developing section 33Y, 33M, 33C and 33K develop the latent images formed on the circumferential surfaces of the photoreceptor drums 31Y, 31M, 31C and 31K, with toner, to yield visual images thereon, respectively. According to the abovementioned process, visual toner images are formed on the circumferential surfaces of the photoreceptor drums 31Y, 31M, 31C and 31K, respectively.

The toner images, respectively formed on the photoreceptor drums 31Y, 31M, 31C and 31K, are sequentially transferred onto a predetermined area of an intermediate transfer belt 41, threaded on the intermediate transfer section 40, one by one, under the transferring actions performed by the first transferring rollers 34Y, 34M, 34C and 34K respectively. Successively, the cleaning sections 35Y, 35M, 35C and 35K remove residual toner remaining on the photoreceptor drums 31Y, 31M, 31C and 31K after the toner image transferring operations have been completed, respectively.

The full color toner image formed on the intermediate transfer belt 41 through the abovementioned process is further transferred onto a paper sheet P under the transferring action performed by a second transferring roller 42. The paper sheet P to be employed for the transferring operation is fed from any one of paper sheet accommodating trays PG1, PG2 and PG3 included in the paper sheet feeding section 90, and then, conveyed to the position of the second transferring roller 42 while a paper sheet feeding roller 91 adjusts the timing for feeding the paper sheet P thereto. After the current operation for transferring the full color toner image has been completed, a belt cleaning section 43 cleans the surface of the intermediate transfer belt 41 so as to prepare the intermediate transfer belt 41 for a next image transferring operation.

The paper sheet P, bearing the full color toner image thereon, is conveyed to the fixing device 50, in which the full color toner image is fixed onto the paper sheet P by applying heat and pressure onto the paper sheet P. In this connection, the details of the fixing device 50 will be described later on.

The paper sheet ejecting and reversing section 70 conveys the paper sheet P, for which the fixing operation has been completed by the fixing device 50, and ejects the paper sheet P concerned onto a paper sheet ejection tray 75. When the paper sheet P is ejected in the obverse and reverse sides inversion mode, an ejection guide 72 once guides the paper sheet P downward. Then, after a pair of ejection reversing rollers 73 has tightly clipped the trailing edge portion of the paper sheet P, the pair of ejection reversing rollers 73 conveys the paper sheet P concerned in the reverse direction, and then, the ejection guide 72 guides the paper sheet P to a pair of ejection rollers 74, so that the pair of ejection rollers 74 ejects the paper shed P onto the paper sheet ejection tray 75.

In this connection, in the case of the duplex image forming mode in which the image forming operation is also applied to the reverse side of the paper sheet P, the ejection guide 72 conveys the paper sheet P, onto obverse side of which the operation for fixing the full color toner image has been completed, to the paper sheet re-feeding section 80 disposed at a downward position. After a pair of re-feed reversing rollers 81 has tightly clipped the trailing edge portion of the paper sheet P, the pair of re-feed reversing rollers 81 conveys the paper sheet P concerned in the reverse direction, so as to convey the paper sheet P, the obverse and reverse sides of which are inverted each other, to a paper sheet re-feeding path 82. According to the abovementioned process, the image forming operation is also applied to the reverse side of the paper sheet P.

Figure 2:
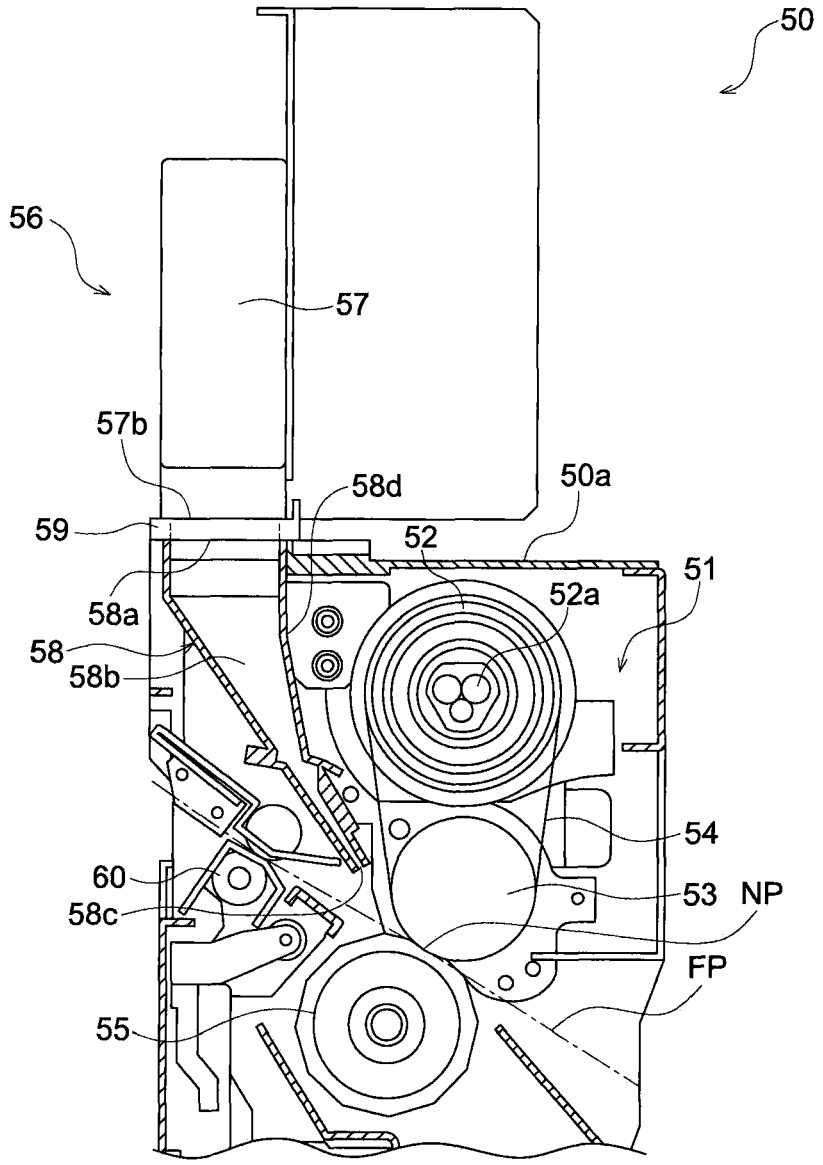
FIG. 2 shows a cross sectional schematic diagram indicating an exemplified structure of a fixing device embodied in the present invention.

The fixing device 50 is constituted by a fixing section 51 and a separating section 56. Incidentally, FIG. 2 shows a cross sectional schematic diagram indicating an exemplified structure of the fixing device 50 embodied in the present invention.

The fixing section 51 is constituted by a heating roller 52, a fixing roller 53, an endless type fixing belt 54 and a pressure roller 55, as its constituents. The heating roller 52 and the fixing roller 53 are disposed in such a manner that both of them are apart from each other so as to place a predetermined distance between them. Further, the endless type fixing belt 54 is threaded on the heating roller 52 and the fixing roller 53. The pressure roller 55 is disposed in such a manner that the pressure roller 55 press-contacts the endless type fixing belt 54 within an area in which the endless type fixing belt 54 and the fixing roller 53 contact with each other, so as to form a fixing nip section NP at the press-contacted area formed between the endless type fixing belt 54 and the pressure roller 55.

In the fixing device 50, the paper sheet P is conveyed in such a manner that the fixing objective surface (namely, the surface, which currently bears the non-fixed toner image) opposes to the endless type fixing belt 54, and passes through the fixing nip section NP during the process of conveying the paper sheet P. Trough the abovementioned process, the operation for fixing the full color toner image onto the paper sheet P is achieved by applying both the heat, conducted from the endless type fixing belt 54 (fixing roller 53), and the pressure, generated by the pressure roller 55, to the paper sheet P concerned. Then, a pair of ejecting rollers 60 ejects the paper sheet P, on which the full color toner image has been fixed, outside the fixing device 50.

The heating roller 52, for instance, is structured by laminating a coating layer (for instance, a fluorine resin) onto a circumferential surface of a pipe made of a cylinder-shaped steel or aluminum, so as to prevent the circumferential surface of the pipe from wearing due to the abrasion with the endless type fixing belt 54. In the interior of the heating roller 52, a heater 52*a* for heating the endless type fixing belt 54, which serves as a heat generating source for thermo-fixing a toner image residing on the paper shed P, is incorporated. The heating roller 52 is heated by the radiation heat generated by the heater 52*a*, and then, the heat stored in the heating roller 52 is transmitted to the endless type fixing belt 54. The heating roller 52 is driven to rotate by a driving force transmitted from a driving member (not shown in the drawings, for instance, a motor), so as to drive the endless type fixing belt 54 to circulate around the fixing roller 53 in accordance with the rotating action of the heating roller 52.

The fixing roller 53 is structured by laminating an elastic layer made of an elastic material, such as a silicone rubber, a sponge, etc., onto a circumferential surface of a column-shaped steel or aluminum. Incidentally, the present embodiment is so constituted that the fixing roller 53 is indirectly heated by the heat generated by the heater 52*a*.

The endless type fixing belt 54 serves as an endless belt structured by laminating a heat resistance layer, an elastic layer and a coating layer, and having a flexibility. In the present embodiment, the heating roller 52 is directly heated by the heater 52*a*, and then, the heat stored in the heating roller 52 is transferred (thermo-conducted) to the endless type fixing belt 54, so as to heat the endless type fixing belt 54 up to the fixing temperature.

The pressure roller 55 is structured by laminating an elastic layer made of a silicone rubber or the like, a separation layer made of a fluorine resin or the like, etc., onto a circumferential surface of a pipe made of a cylinder-shaped steel or aluminum. In this connection, the pressure roller 55 also incorporates a heater in the interior thereof so as to make it possible to apply supplemental heat for achieving the thermo-fixing operation to the paper sheet P.

The separating section 56 is constituted by an air blasting fan 57, a duct 58 and a thermal insulating member 59. The air blasting fan 57 and the duct 58 are connected to each other, while inserting the thermal insulating member 59 between them in such a manner that the air can be communicated through the thermal insulating member 59 so as not to impede the air flow from the air blasting fan 57 to the duct 58.

The separating section 56 is disposed downstream the fixing section 51 in a conveyance path FP of paper sheet P so that the leading edge portion (an air blow opening 58*c*, detailed later) of the duct 58 is arranged at a position opposing the paper sheet ejection side of the fixing nip section NP. The air blasted by the air blasting fan 57 flows through the interior of the duct 58, and then, is emitted from an air blow opening 58*c*, so as to separate the paper sheet P from the endless type fixing belt 54 by employing the air pressure of the airflow (separation wind) blown from the air blow opening 58*c*. In the present embodiment, three separating sections 56, each being equivalent to the abovementioned separating section 56, are arranged horizontally in a paper sheet width direction (orthogonal to the paper sheet conveyance direction).

Figure 3:
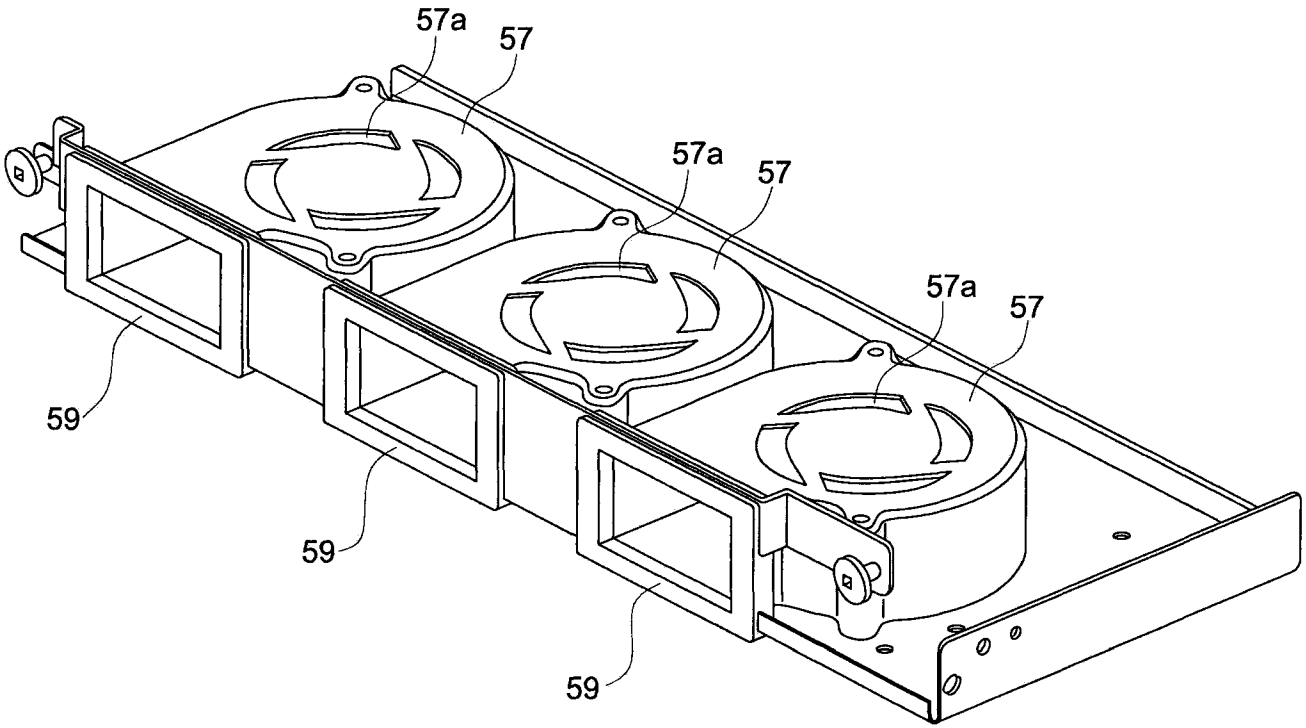
FIG. 3 shows a perspective view indicating three air blasting fans and three thermal insulating members, which constitute three separating sections, respectively.
Figure 4:
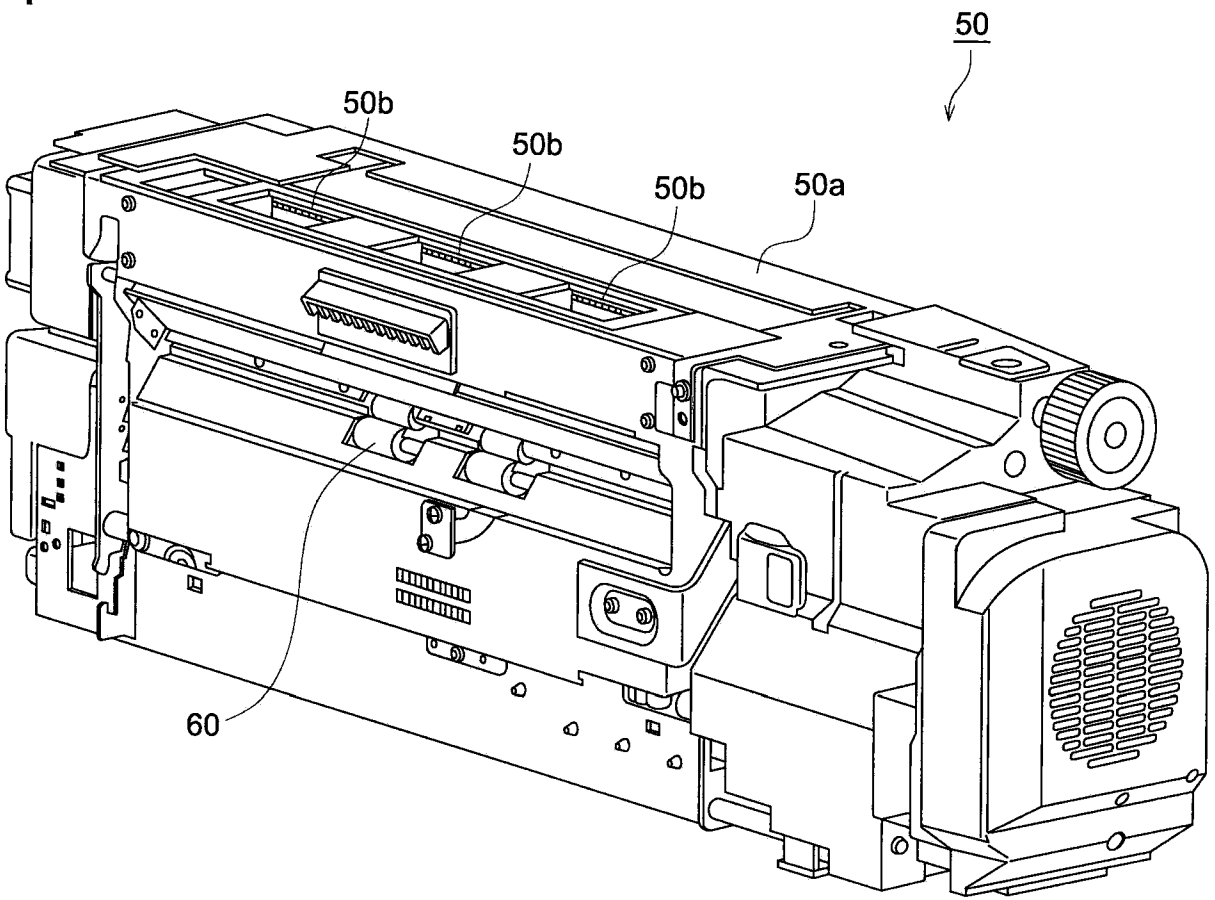
FIG. 4 shows a perspective view indicating a fixing device in such a state that three air blasting fans and three thermal insulating members are removed therefrom.

FIG. 3 shows a perspective view indicating the three air blasting fans 57 and the three thermal insulating members 59, which constitute the three separating sections 56, respectively, while FIG. 4 shows a perspective view indicating the fixing device 50 in such a state that the three air blasting fans 57 and the three thermal insulating members 59 are removed therefrom. The air blasting fan 57 takes the air into the interior thereof from an air intake opening 57*a*, so as to blast the air through an air blast opening 57*b*. The three air blasting fans 57 are mounted onto an outer wall surface (an upper wall surface 50*a*, in the present embodiment) of the housing in which the fixing section 51 and a part of the separating section 56 (duct 58) are accommodated. Concretely speaking, the three thermal insulating members 59, detailed later, are attached onto the three air intake openings 57*a*, respectively, and then, the three air blasting fans 57 are mounted onto the upper wall surface 50*a* in such a manner that the three air intake openings 57*a* correspond to three opening sections 50*b* provided on the upper wall surface 50*a*, respectively. Due to the feet that the air blasting fan 57 takes the air into the interior thereof the disposition of the three air blasting fans 57 are determined by considering various kinds of design demands (design factors), such as the fact that it is convenient to dispose the air blasting fan 57 outside the housing, a demand for shortening the distance from the air blasting fan 57 to the endless type fixing belt 54 (traveling distance of the separation wind) as shorter as possible, a demand for disposing the duct 58 at a position near the heating roller 52 (heater 52*a*), etc. In this connection, the scope of the shape and configuration of the air blasting fan 57 is not limited to those abovementioned. Any kind of shape and configuration is applicable in the present invention, as far as the concerned fan satisfies the function for blasting the air. Further, it is also applicable that the air blasting fan 57 blasts the air residing inside the machine instead of the air residing outside the machine. Still further, it is also applicable that the air blasting fan 57 blasts a certain kind of gas other than the air.

Figure 5:
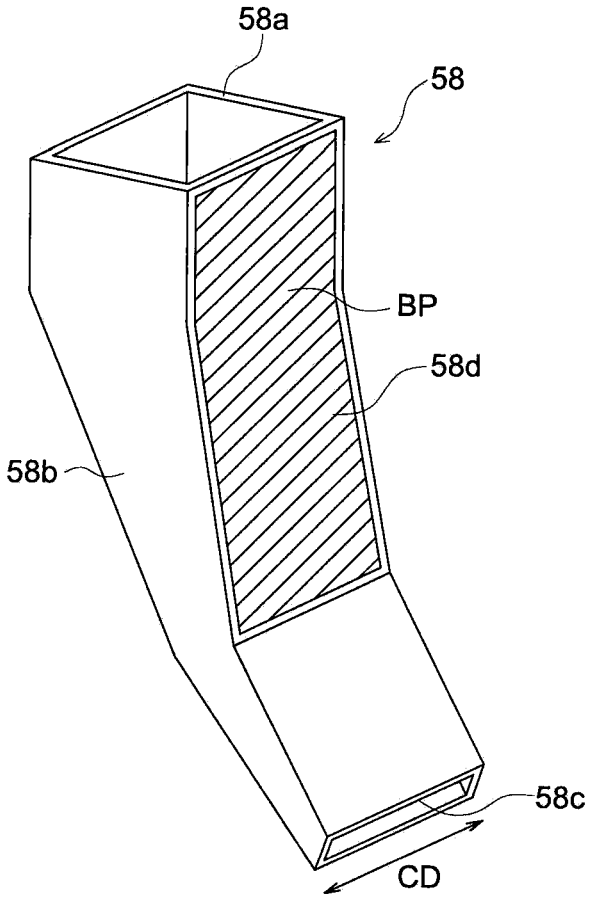
FIG. 5 shows a perspective view indicating a duct schematically.

FIG. 5 shows a perspective view indicating the duct 58 schematically. The duct 58 is made of a metal material, such as an aluminum, etc., the cross sectional shape of which is formed in a rectangular, and is disposed at a position near the heating roller 52 (heater 52*a*). When the duct 58 is apprehended from the functional point of view, the duct 58 is constituted by an air entrance opening 58*a* from which the air is blasted into the duct 58, an airflow guide section 58*b* guiding the airflow concerned, and the air blow opening 58*c* from which the air is brown. The air blasted from the air entrance opening 58*a* is guided along the airflow guide section 58*b*, and is ejected from fee air blow opening 58*c*.

The air entrance opening 58*a* is formed in such a shape that corresponds to the shape of the air blast opening 57*b*, so that the air entrance opening 58*a* is attached to the opening section 50*b* provided on the upper wall surface 50*a* of the housing. The air blow opening 58*c* is disposed at such a position that is shifted towards the endless type fixing belt 54 side from the front position located at the ejection side of the fixing nip section NP (above the conveyance path FP of the paper sheet P), and that the air is brown to the heating roller 52 along a tangential direction of the endless type fixing belt 54. The abovementioned disposition of the air blow opening 58*c* is determined on the basis of the knowledge acquired by the present inventors, such that, among the endless type fixing belt 54 and the pressure roller 55, both of which contact the paper sheet P at fixing nip section NP, the tendency (possibility) that the paper sheet P wraps around the endless type fixing belt 54, which substantially contacts the fixing objective surface of the paper sheet P, is stronger than that of the other. In addition to the abovementioned, the shape of the air blow opening 58*c* is formed in such an opening shape that is elongated in a longitudinal direction coinciding with the width direction of the paper sheet P (direction orthogonal to the conveyance direction of the paper sheet P). Due to the elongated opening shape abovementioned, it becomes possible not only to make the separation wind widely spread in the width direction of the paper sheet P, but also to suppress the unevenness of the wind amount distribution in the width direction of the paper sheet P.

In the duct 58, a black color coating BP is applied onto a surface of the duct wall constituting the airflow guide section 58*b*, namely, an outer surface of a duct wall that opposes to the heating roller 52 (hereinafter, referred to as an opposing wall surface 58*d*). Since the air entrance opening 58*a* opposes to the heating roller 52, the air entrance opening 58*a* serves as a heat receiving surface for receiving the radiation heat irradiated from the heating roller 52 (radiation heat caused by the heater 52*a*). Further, by applying the black color coating BP onto the outer surface of the opposing wall surface 58*d*, it becomes possible to heighten the efficiency for absorbing the radiation heat irradiated from the heating roller 52, as an innovation to be applied. Receiving the radiation heat irradiated from the heating roller 52 onto the heat receiving surface (opposing wall surface 58*d*), the duct 58 transfers the above-absorbed heat to the air (separation air) currently flowing inside the airflow guide section 58*b*, so as to heat up the separation air.

The thermal insulating member 59 is formed in shape of rectangular frame having a through hole area corresponding to the air entrance opening 58*a* of the duct 58, therein, and is made of a material that suppresses the thermal conduction, in other words, made of a material having thermal insulation properties. The thermal insulating member 59 is inserted between the duct 58 and the air blasting fan 57, so that both of them are connected in such a state that the airflow can be freely communicate between them.

As described in the foregoing, according to the present embodiment, the opposing wall surface 58*d* of the duct 58 serves as the heat receiving surface that receives the radiation heat irradiated from the fixing section 51. Further, the structure of the duct 58 and the air blasting fan 57 is provided with the thermal insulating member 59, serving as the connection structure that suppresses the thermal conduction from duct 58 to the air blasting fan 57, therebetween. Among the parts constituting the air blasting fan 57, some kinds of parts, such as a bearing that rotatably support the propeller shaft, electronic parts including capacitors mounted into the driving circuit, etc., are substantially vulnerable in the high temperature environment, and therefore, are factors for causing the deterioration of the air blasting fan 57. According to the present embodiment, however, even when the temperature of the duct 58 has risen due to the influence of the heat receiving surface, it becomes possible to prevent the air blasting fan 57 form causing such inconvenience that the heat of the duct 58 is transferred to the air blasting fan 57 to excessively rise the temperature thereof.

Further, according to the present embodiment, the air can be heated up by the radiation heat received by the heat receiving surface during the process that the air, blasted by the air blasting fan 57, is flowing through the inside of the duct 58. Accordingly, it becomes possible to prevent the fixing device 50 from causing such an inconvenient situation that the fixing temperature is excessively lowered by blowing a low temperature separation wind to the fixing nip section NP. Further, compared to such the conventional case that intermittent air blows are emitted, since a constant amount of air can be continuously blasted by employing the air blasting fan 57, it becomes possible to conduct the air blasting operation in a stable state. Accordingly, it becomes possible to prevent the fixing device 50 from causing such an inconvenient state that the fixing temperature becomes unstable.

Still further, according to the present embodiment, the air blasting fan 57 is disposed at a position located in the peripheral space of the fixing device 50 (upper wall surface 50*a*). Since the compression ratio of the air blasting fan 57 is relatively small, compared to that of a compressor or the like, there has been such a possibility that the longer the traveling path of the separation wind is, the more insufficient the wind velocity to be acquired at the time of the operation for separating the paper sheet P becomes. According to the present embodiment, however, by employing the abovementioned disposition of the air blasting fan 57, it becomes possible to shorten the distance from the air blasting fan 57 to the endless type fixing belt 54 (length of the traveling path of the separation wind). Incidentally, although the air blasting fan 57 is exemplified as the air blasting device for blasting the separation wind in the present embodiment, other than the above, it is also applicable that, for instance, a blower is employed as the air blasting device for continuously blasting the separation wind.

In this connection, according to the connecting structure between the duct 58 and the air blasting fan 57 in the present embodiment, the thermal insulating member 59 is inserted between the duct 58 and the air blasting fan 57, so as to suppress the heat transferring action from the duct 58 to the air blasting fan 57. However, the scope of the connecting structure between the duct 58 and the air blasting fan 57 is not limited to the above. The following method can be also employed, as far as the connecting structure between the duct 58 and the air blasting fan 57 is such a structure that the heat transferring action from the duct 58 to the air blasting fan 57 can be suppressed.

Figure 6:
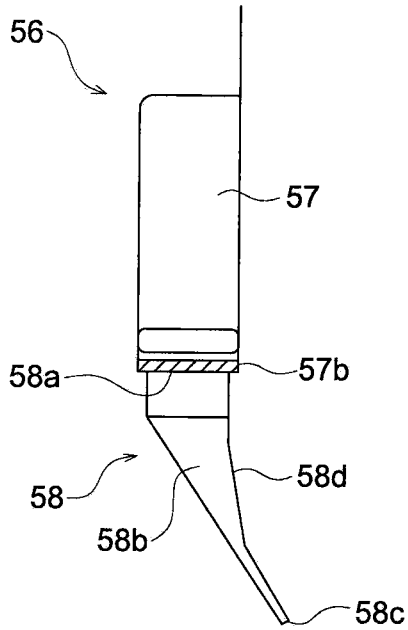
FIG. 6 shows an explanatory schematic diagram indicating a modified connection structure between a duct and an air blasting fun.

As shown in FIG. 6, it is applicable that, in the air blasting fan 57, the length of the air blast opening 57*b* (indicated by the hatched area shown in FIG. 6) is set at a predetermined value in the air blasting direction, and the air blast opening 57*b* is made of such a material that has a heat insulation property (for instance, an urethane foam). According to the connecting structure shown in FIG. 6, the air blasting fan 57 and the duct 58 are connected to each other in such a manner that the air blast opening 57*b* is directly connected to the air entrance opening 58*a* of the duct 58. Even if the abovementioned connecting structure is employed, the air blast opening 57*b* of the air blasting fan 57 surely serves as the member for suppressing the heat transferring action from the duct 58 to the air blasting fan 57. Accordingly, it becomes possible to prevent the fixing device 50 from causing such an inconvenient situation that the heat is transferred from the duct 58, heated by the heating roller 52, to the main body of the air blasting fan 57, without employing the thermal insulating member 59.

Figure 7:
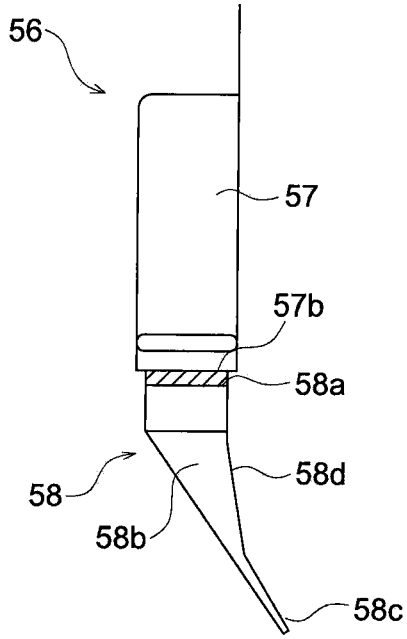
FIG. 7 shows an explanatory schematic diagram indicating another modified connection structure between a duct and an air blasting fun.

Further, as shown in FIG. 7, in the duct 58, the length of the air entrance opening 58*a* (indicated by the hatched area shown in FIG. 7) is set at a predetermined value in the air blasting direction, and the air entrance opening 58*a* is made of such a material that has a heat insulation property (for instance, an urethane foam). According to the connecting structure shown in FIG. 7, the air blasting fan 57 and the duct 58 are connected to each other in such a manner that the air entrance opening 58*a* is directly connected to the air blast opening 57*b* of the air blasting fan 57. Even if the abovementioned connecting structure is employed, the air entrance opening 58*a* of the duct 58 surely serves as the member for suppressing the heat transferring action from the duct 58 to the air blasting fan 57. Accordingly, it becomes possible to prevent the fixing device 50 from causing such an inconvenient situation that the heat is transferred from the duct 58, heated by the heating roller 52, to the main body of the air blasting fan 57, without employing the thermal insulating member 59.

Still further, it is also applicable that the combination of the thermal insulating member 59, indicated in the aforementioned embodiment, and any one or both of the methods, shown in FIGS. 6 and 7, is employed as the connecting structure between the air blasting fan 57 and the duct 58. According to the abovementioned combination, it becomes possible to suppress the heat transferring action between the air blasting fan 57 and the duct 58 more effectively than ever.

In the embodiment exemplified in the above, the black color coating BP is applied onto the opposing wall surface 58*d*, serving as the heat receiving surface, so as to heighten the heat collecting efficiency thereof. However, the scope of the color of the coating is not limited to the black color. Any one of various kinds of colors may be applicable as the color of the coating, as far as the heat collecting efficiency can be heightened by applying the coating BP of the color concerned. Hereinafter in the present specification, the coating, having any one of various kinds of colors that have a capability for heightening the heat collecting efficiency, is defined as the black color coating BP as its general term.

Further, although the outer wall surface of the duct 58, opposing to the fixing section 51, (opposing wall surface 58*d*) is employed as the heat receiving surface in the present embodiment, the scope of the heat receiving surface is not limited to the above. Any surface may be employed as the heat receiving surface, as far as the concerned surface can receive the radiation heat irradiated from the fixing section 51.

Second Embodiment

Figure 8:
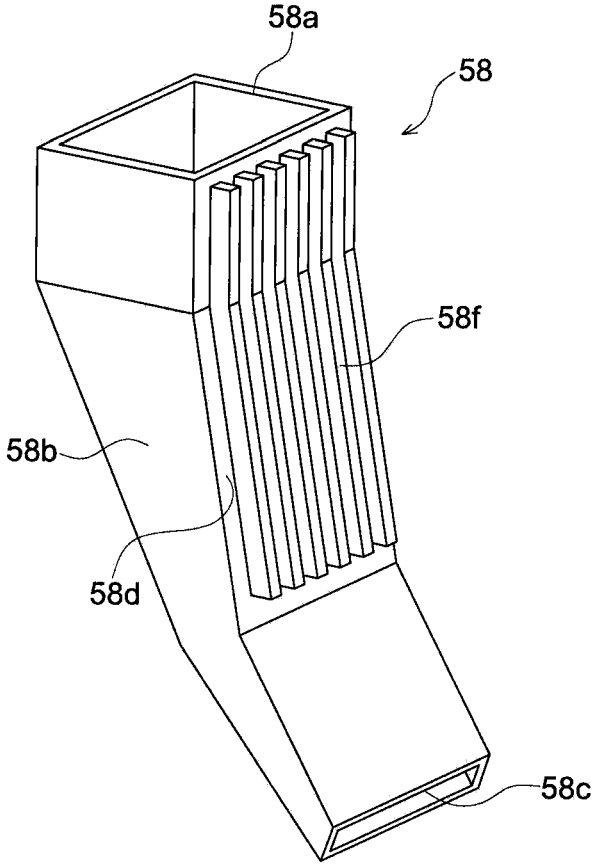
FIG. 8 shows a perspective view schematically indicating a duct constituting a separating section of a fixing device, embodied in the present invention as the second embodiment.

FIG. 8 shows a perspective view schematically indicating the duct 58 constituting the separating section 56 of the fixing device 50, embodied in the present invention as the second embodiment. The point that the duct 58 of the second embodiment is different from that of the first embodiment is the structure of the opposing wall surface 58*d* for receiving the radiation heat irradiated from the heating roller 52. In this connection, the different points between the first and second embodiments will be mainly detailed in the following, while the duplicate descriptions same as those of the first embodiment will be omitted.

In the structure of the second embodiment, the duct 58 is provided with a plurality of heat condensing fins 58*f* formed on the outer surface of the opposing wall surface 58*d*. Each of the plurality of heat condensing fins 58*f* is formed by employing a plate shaped member elongated in the wind blasting direction, and the plural heat condensing fins 58*f* are arranged in the width direction (direction orthogonal to the wind blasting direction among the two dimensional directions on the opposing wall surface 58*d*) at equal intervals. For instance, each of the plurality of heat condensing fins 58*f* is made of a metal material having high heat conductivity, such as an aluminum, etc., and is welded onto the outer surface of the opposing wall surface 58*d*.

According to the second embodiment as described in the above, it becomes possible to make the duct 58 secure the total heat receiving area being wider than ever, compared to such the case that the opposing wall surface 58*d*, serving as the heat condensing surface, is formed in the flat surface shape.

Accordingly, it becomes possible to efficiently collect the radiation heat irradiated from the heating roller 52, so as to make it possible to effectively heat the air flowing through the interior of the duct 58.

In this connection, although each of plurality of heat condensing fins 58*f* is structured to elongate in the wind blasting direction in the second embodiment, the structural scope of fee plurality of heat condensing fins 58*f* is not limited to fee above. It is also applicable that, for instance, each of plurality of heat condensing fins 58*f* is structured to elongate in the width direction, or in any other direction. Further, although the plate shaped member is straightly elongated to form each of plurality of heat condensing fins 58*f* in the second embodiment, it is also applicable feat the plate shaped member is elongated along any one of various kinds of curved lines, such as a waveform curvature, a sawtooth curvature, etc., to form each of plurality of heat condensing fins 58*f*. Still further, although each of plurality of heat condensing fins 58*f* is formed as fee plate shaped member in fee second embodiment, it is also applicable that each of plurality of heat condensing fins 58*f* is formed as a column shaped member.

Third Embodiment

Figure 9:
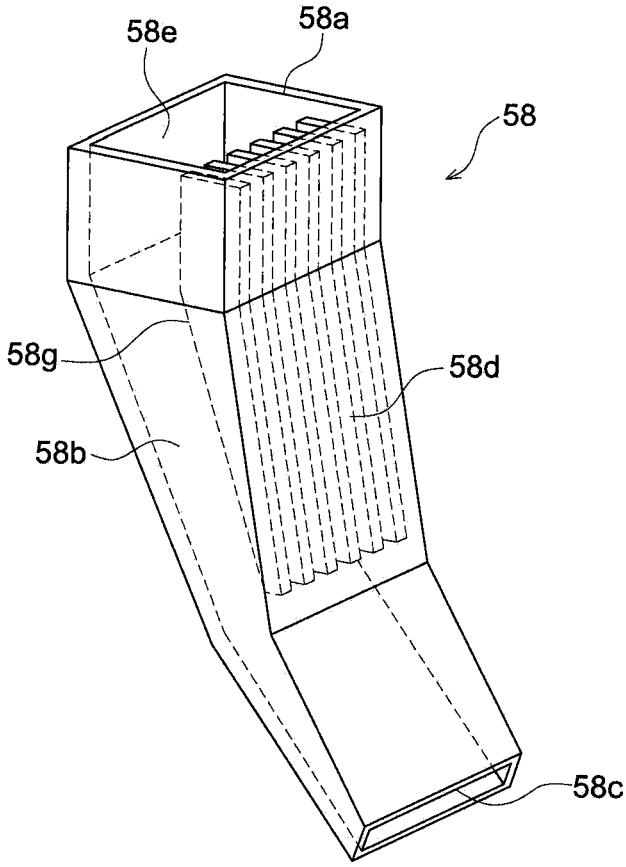
FIG. 9 shows a perspective view schematically indicating a duct constituting a separating section of a fixing device, embodied in the present invention as the third embodiment.

FIG. 9 shows a perspective view schematically indicating fee duct 58 constituting fee separating section 56 of fee fixing device 50, embodied in the present invention as fee third embodiment. The point that the duct 58 of the third embodiment is different from that of fee first embodiment is fee structure for transferring the heat received by the opposing wall surface 58*d*, serving as fee heat receiving surface that receives fee radiation heat irradiated from fee heating roller 52, to the separation wind. In this connection, fee different points between fee first and third embodiments will be mainly detailed in fee following, while fee duplicate descriptions same as those of fee first embodiment will be omitted.

In the structure of fee third embodiment, the duct 58 is provided wife a plurality of heat radiation fins 58*g* formed on the inner surface of the opposing wall surface 58*d*. Each of the plurality of heat radiation fins 58*g* is formed by employing a plate shaped member elongated in fee wind blasting direction, and the plural heat radiation fins 58*g* are arranged in fee width direction (direction orthogonal to the wind blasting direction among fee two dimensional directions on fee opposing wall surface 58*d*) at equal intervals. For instance, each of fee plurality of heat radiation fins 58*g* is made of a metal material having high heat conductivity, such as an aluminum, etc., and is welded onto the outer surface of fee opposing wall surface 58*d*. Further, fee height of each of fee plurality of heat radiation fins 58*g* is set at such a length feat is shorter than fee distance between fee opposing wall surface 58*d* and a duct wall 58*e*, which opposes the opposing wall surface 58*d*, in its height direction (direction perpendicular to the opposing wall surface 58*d*), so as not to reach the inner surface of the duct wall 58*e*.

According to the third embodiment as described in the above, since it is possible to heighten the heat transfer efficiency from the plurality of heat radiation fins 58*g* provided on the opposing wall surface 58*d* to the separation wind, it becomes possible to effectively heat up the separation wind. Further, the height of each of the plurality of heat radiation fins 58*g* is set at such the length that is shorter than the distance between the opposing wall surface 58*d* and a duct wall 58*e*, so as not to make the top portions of the heat radiation fins 58*g* contact the inner surface of the duct wall 58*e*. If anyone of the top portions of the heat radiation fins were in contact with the inner surface of the duct wall 58*e*, the heat would be dispersed outside the duct 58 through the duct wall 58*e*, possibly resulting in the deterioration of the heating efficiency of the separation wind. According to the third embodiment, however, by restricting the height of each of the plurality of heat radiation fins 58*g*; it becomes possible to suppress such the inconvenience as abovementioned.

In this connection, the third embodiment is so constituted that each of the plurality of heat radiation fins 58*g* is elongated in the wind blasting direction. This is an innovation for alleviating the air resistance to be generated between the separation wind and the plurality of heat radiation fins 58*g*, and the present inventors have derived this innovation from such a viewpoint that the plurality of heat radiation fins 58*g* should be equipped so as not to impede the airflow of the separation wind. However, if the air resistance is not such the main factor for impeding the airflow, it is possible to employ any one of various kinds of structures as described in the second embodiment Further, it is needless to say that the third embodiment including the plurality of heat radiation fins 58*g* is combinable with the second embodiment including the plurality of heat condensing fins 58*f*

Fourth Embodiment

Figure 10:
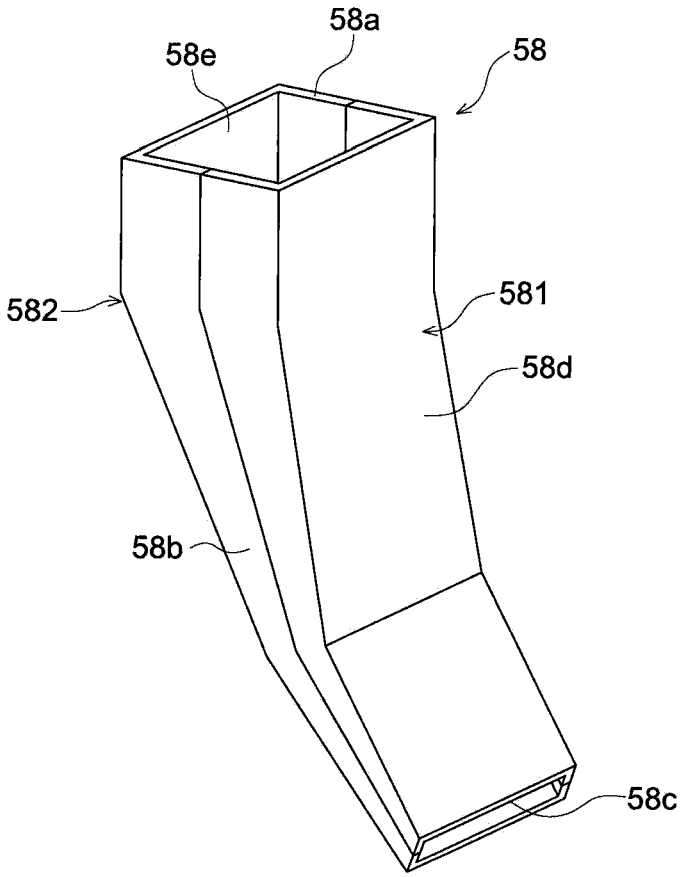
FIG. 10 shows a perspective view schematically indicating a duct constituting a separating section of a fixing device, embodied in the present invention as the fourth embodiment.

FIG. 10 shows a perspective view schematically indicating the duct 58 constituting the separating section 56 of the fixing device 50, embodied in the present invention as the fourth embodiment The point that the duct 58 of the fourth embodiment is different from that of the first embodiment lays on the fact that the duct 58 is constituted by two members, heat conductivities of which are different from each other. In this connection, the different points between the first and fourth embodiments will be mainly detailed in the following, while the duplicate descriptions same as those of the first embodiment will be omitted.

The duct 58 of the fourth embodiment is constituted by a first member 581, including the opposing wall surface 58*d* serving as a heat receiving surface for receiving the radiation heat irradiated from the heating roller 52, and a second member 582 including the duct wall 58*e* that opposes to the opposing wall surface 58*d*, both of which are connected with each other as shown in FIG. 10. In other words, the duct 58 of the fourth embodiment is constituted by two members including the first member 581 and the second member 582, which are divided into two members substantially along the wind blasting direction of the separation wind. In the abovementioned structure, the first member 581 is made of a material having high heat conductivity (for instance, an aluminum or the like), while the second member 582 is made of such another material that has a heat conductivity being lower than that of the first member 581 (for instance, a resin material or the like).

According to the fourth embodiment as described in the above, the duct 58 is so constituted that the duct wall 58*e*, opposing to the opposing wall surface 58*d* (heat receiving surface), is made of such the material, the heat conductivity of which is lower than that of the other material, of which the opposing wall surface 58*d* serving as the heat receiving surface is made. According to the abovementioned structure, it becomes possible to suppress an occurrence of such an inconvenient situation that the heat retained within the separation wind is dispersed outside the duct 58 through the duct wall 58*e*. As a result, it becomes possible to suppress the deterioration of the heating efficiency of the separation wind, and accordingly, it becomes possible to efficiently heat the separation wind.

Further, it is needless to say that the fourth embodiment is combinable with the second embodiment including the plurality of heat condensing fins 58*f* and/or the third embodiment including the plurality of heat radiation fins 58*g*.

Although the several examples of the image forming apparatus embodied in the present invention have been described in the foregoing, it is needless to say that modifications and additions made by a skilled person in regard to the exemplified embodiments without departing from the spirit and scope of the invention shall be included in the scope of the present invention. Further, the fixing device itself functions as a part of the present invention. In this case, it is applicable that the configuration of the fixing device includes the wind blasting section as its constituent, or does not include the wind blasting section as its constituent on the premise that the fixing device is provided with such a connection structure that suppresses the heat conduction with the wind blasting section.

According to the present invention, since the heat conducting action from the duct to the air blasting section is suppressed, it becomes possible to prevent the air blasting section from deterioration caused by heat transferred from the duct Accordingly, it becomes possible to stably operate the separating section, resulting in an extension of its lifetime.

While the preferred embodiments of the present invention have been described using specific term, such description is for illustrative purpose only, and it is to be understood that changes and variations may be made without departing from the spirit and scope of the appended claims.

What is claimed is:

1. A fixing device that is provided with a pair of fixing members, which press-contact with each other to form a fixing nip section, comprising:

a fixing section to apply heat and pressure onto a toner image transferred onto a paper sheet by making the paper sheet pass through the fixing nip section, so as to fix the toner image onto the paper sheet;

a heat source to generate the heat to be applied onto the toner image; and a separating section to blow a gas onto the paper sheet on a paper sheet ejection side of the fixing nip section so as to separate the paper sheet from the pair of fixing members;

wherein the separating section comprises:

a gas blasting section to blast the gas; and a duct coupled to the gas blasting section at a coupling section as to guide the gas blasted by the gas blasting section to the paper sheet on the paper sheet ejection side of the fixing nip section, the duct including a duct wall serving as a heat receiving surface to receive radiation heat irradiated from the fixing section; and wherein the coupling section is provided with a thermal insulating member that suppresses heat transferring action from the duct to the gas blasting section.

2. The fixing device of claim 1, wherein the thermal insulating member that is made of a material having a thermal insulation property and that is inserted in the coupling section in such a state that a flow of the gas can be freely communicated between the duct and the gas blasting section.

3. The fixing device of claim 1, wherein a gas blast opening of the gas blasting section is made of a material having a thermal insulation property, and is connected to the duct.

4. The fixing device of claim 1, wherein the gas blasting section includes a fan.

5. The fixing device of claim 1, wherein a black color coating is applied onto an outer surface of the duct wall serving as the heat receiving surface; and wherein the black color coating is defined as such a coating that has any one of various kinds of colors, having a capability for heightening a heat collecting efficiency, as its general term.

6. The fixing device of claim 1, wherein the duct is provided with a heat condensing fin fixed or formed onto an outer surface of the duct wall serving as the heat receiving surface.

7. The fixing device of claim 1, wherein the duct is provided with a heat radiation fin fixed or formed onto an inner surface of the duct wall serving as the heat receiving surface.

8. The fixing device of claim 7, wherein the height of the heat radiation fin is set at such a length that is shorter than a distance between another inner surface of an opposing wall, which opposes the inner surface of the duct wall, and the inner surface of the duct wall, so that the heat radiation fin does not reach the other inner surface of the opposing wall.

9. The fixing device of claim 7, wherein the heat radiation fin is formed in such a shape that a resistance against the flow of the gas is made to reduce.

10. The fixing device of claim 1, wherein a heat conductivity of a material, of which an opposing wall located at an opposing side of the duct wall is made, is lower than that of another material, of which the duct wall serving as the heat receiving surface is made.

11. A fixing device that is provided with a pair of fixing members, which press-contact with each other to form a fixing nip section, comprising:

a fixing section to apply heat and pressure onto a toner image transferred onto a paper sheet by making the paper sheet pass through the fixing nip section, so as to fix the toner image onto the paper sheet;

a heat source to generate the heat to be applied onto the toner image; and a separating section to blow a gas onto the paper sheet on a paper sheet ejection side of the fixing nip section so as to separate the paper sheet from the pair of fixing members;

wherein the separating section comprises a duct to guide a flow of the gas to the pair of fixing members, the duct including a duct wall serving as a heat receiving surface to receive radiation heat irradiated from the fixing section;

wherein the duct is provided a connection structure for connecting the duct with a gas blasting section, which blasts the flow of gas towards the duct and wherein the connection structure suppresses heat transferring action from the duct to the gas blasting section.

12. The fixing device of claim 11, further comprising:

a thermal insulating member that is made of a material having a thermal insulation property, the thermal insulating member being inserted in the connection structure between the duct and the gas blasting section.

13. The fixing device of claim 11, wherein a black color coating is applied onto an outer surface of the duct wall serving as the heat receiving surface; and wherein the black color coating is defined as such a coating that has any one of various kinds of colors, having a capability for heightening a heat collecting efficiency, as its general term.

14. The fixing device of claim 11, wherein the duct is provided with a heat condensing fin fixed or fanned onto an outer surface of the duct wall serving as the heat receiving surface.

15. The fixing device of claim 11, wherein the duct is provided with a heat radiation fin fixed or fanned onto an inner surface of the duct wall serving as the heat receiving surface.

16. The fixing device of claim 15, wherein the height of the heat radiation fin is set at such a length that is shorter than a distance between another inner surface of an opposing wall, which opposes the inner surface of the duct wall, and the inner surface of the duct wall, so that the heat radiation fin does not reach the other inner surface of the opposing wall.

17. The fixing device of claim 15, wherein the heat radiation fin is fanned in such a shape that a resistance against the flow of the gas is made to reduce.

18. The fixing device of claim 11, wherein a heat conductivity of a material, of which an opposing wall located at an opposing side of the duct wall is made, is lower than that of another material, of which the duct wall serving as the heat receiving surface is made.

19. An image forming apparatus, comprising:

a transferring unit to transfer a toner image onto a paper sheet; and a fixing unit to fix the toner image onto the paper sheet, onto which the toner image is transferred by the transferring unit;

wherein the fixing device is provided with a pair of fixing members, which press-contact with each other to form a fixing nip section, and comprises:

a fixing section to apply heat and pressure onto the toner image transferred onto the paper sheet by making the paper sheet pass through the fixing nip section, so as to fix the toner image onto the paper sheet;

a heat source to generate the heat to be applied onto the toner image; and a separating section to blow a gas onto the paper sheet on a paper sheet ejection side of the fixing nip section so as to separate the paper sheet from the pair of fixing members;

wherein the separating section comprises:

a gas blasting section to blast the gas; and a duct coupled to the gas blasting section at a coupling section as to guide the gas blasted by the gas blasting section to the paper sheet on the paper sheet election side of the fixing nip section, the duct including a duct wall serving as a heat receiving surface to receive radiation heat irradiated from the fixing section; and wherein the coupling section is provided with a thermal insulating member that suppresses heat transferring action from the duct to the gas blasting section.

* * * * *